United States Patent [19]

D'Andrade

[11] 4,289,109

[45] Sep. 15, 1981

[54] TOY AIR PISTOL WITH HOLLOW BREECH SLIDE

[75] Inventor: Bruce M. D'Andrade, Whitehouse Station, N.J.

[73] Assignee: Arco Industries Ltd., Hong Kong, Hong Kong

[21] Appl. No.: 143,849

[22] Filed: Apr. 25, 1980

[51] Int. Cl.[3] ..... F41B 11/00

[52] U.S. Cl. ..... 124/67; 273/344

[58] Field of Search ..... 124/27, 66, 67, 68; 273/344; 46/1 E

[56] References Cited

U.S. PATENT DOCUMENTS

| | | | |
|---|---|---|---|
| 439,246 | 10/1890 | Joslin | 124/67 |
| 786,426 | 4/1905 | Daniels | 124/66 |
| 1,199,074 | 9/1916 | Heyman et al. | 124/66 |
| 1,692,555 | 11/1928 | Lewis | 124/67 |
| 1,868,292 | 7/1932 | Roe | 124/67 |
| 2,132,173 | 10/1938 | Lefever | 124/67 |
| 2,306,668 | 12/1942 | Stevens | 124/67 |
| 3,818,887 | 6/1974 | Akiyama et al. | 124/67 |
| 3,859,977 | 1/1975 | Lange | 124/66 |
| 4,212,285 | 7/1980 | Cagan et al. | 124/67 |

*Primary Examiner*—Richard T. Stouffer
*Attorney, Agent, or Firm*—C. Hercus Just

[57] ABSTRACT

A toy pistol formed by molding from relatively rigid plastic material and comprising a hollow elongated frame portion having a handle depending from one end, a composite tubular barrel and coaxial cylinder rearward thereof and of larger diameter than said barrel and supported within the frame, a piston slidable in the cylinder and having a rearwardly extending piston rod surrounded by a compression spring and having a transverse shoulder member adjacent but spaced from the piston, a trigger pivotally mounted adjacent the handle and having a sear engageable with the shoulder member when the piston is in rearward cocked position and the spring is compressed, and a simulated hollow breech slide slidable longitudinally upon the upper rearward part of the frame portion above the handle and operable when moved rearwardly to retract the piston rod and piston to cocked position to compress the spring and permit the sear to engage the transverse shoulder as aforesaid.

5 Claims, 8 Drawing Figures

Fig. 1
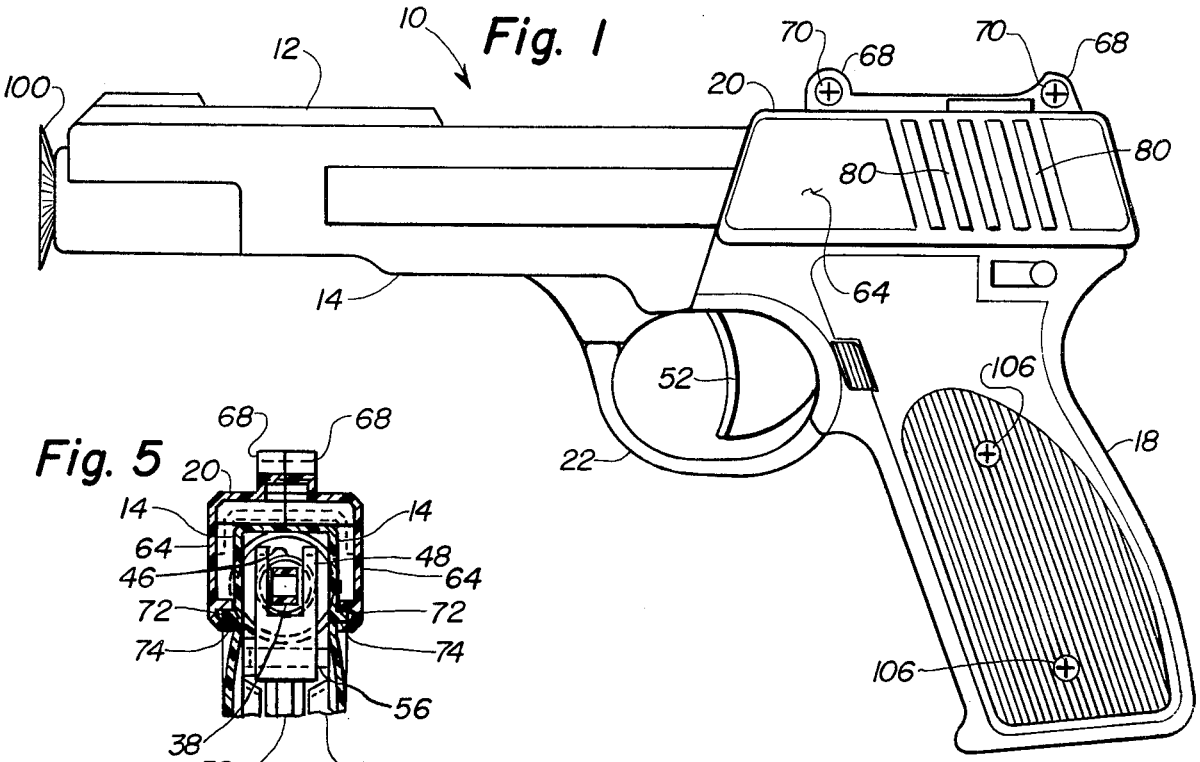
Fig. 5
Fig. 2
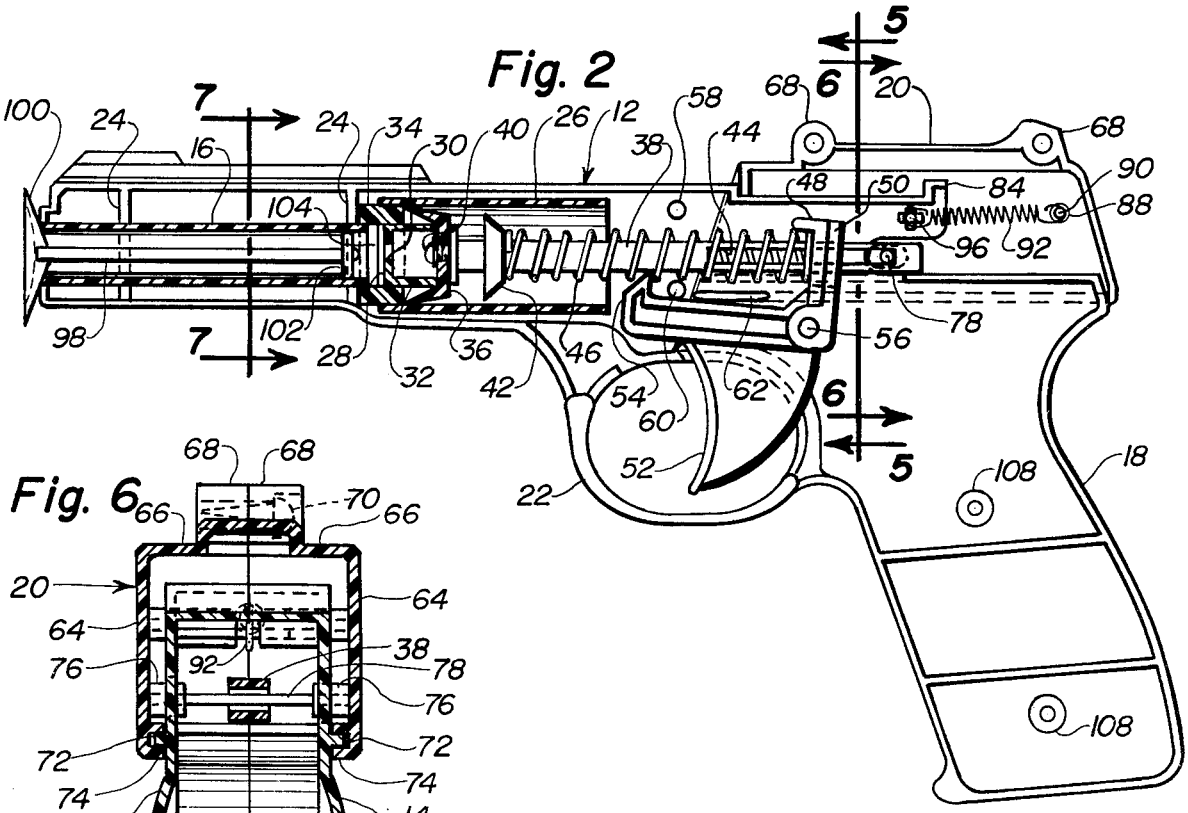
Fig. 6
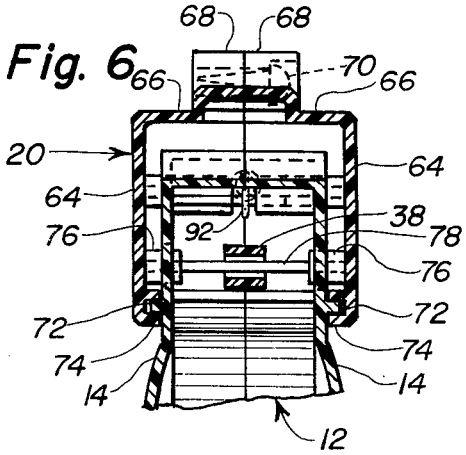

TOY AIR PISTOL WITH HOLLOW BREECH SLIDE

BACKGROUND OF THE INVENTION

Toy air pistols and rifles have been in existence for many years. Quite a few years ago they were known as pop guns in which a piston was retracted against a spring which was compressed, such as by pivoting the stock of the rifle relative to the barrel, such movement causing a sear to engage the piston or mechanism connected to it to hold the same in cocked position, whereupon movement to the trigger released the sear and caused the piston to compress air in the barrel against a cork or other similar projectile pushed into the outer end of the barrel and thereby shot the cork forwardly against a toy soldier, target, or otherwise. Typical examples of such air rifles or pop guns comprise the subject matter of prior U.S. Pat. Nos. 439,246 to Joslin, dated Oct. 28, 1890 and 1,119,074 to Heyman et al, dated Sept. 26, 1916.

Toy pistols also have previously been developed in which compressed air shoots projectiles from a barrel, the air pressure is generated by a piston which is spring pressed when released by a sear controlled by a trigger, cocking of said guns being effected by slidably moving the barrel relative to a frame from which a handle projects and typical examples of this type of pistol are found in prior U.S. Pat. Nos. 786,426 to Daniels, dated Apr. 4, 1905, and 2,132,173 to Lefever, dated Oct. 4, 1938.

Still another air pistol designed to shoot pellets capable of being projected substantial distances with considerable force also have been developed and one example of this type of pistol comprises the subject matter of prior U.S. Pat. No. 1,692,555 to Lewis, dated Nov. 20, 1928, and in which a slidable breech block is actuated by means of a relatively awkward lever pivoted adjacent the inner end of the barrel and movable up and over the barrel to operable a link connected between one end of said lever and the forward end of the breech block for purposes of compressing the spring of a piston movable in an air chamber, the arrangement being that when the breech block is retracted to rearward position, a pellet may be inserted in the breech end of the barrel and is in position to have compressed air directed against the pellet, which has a rearwardly extending skirt which wipingly engages the walls of the barrel to render application of the compressed air highly efficient.

It is the purpose of the present invention to provide a toy air pistol formed preferably from relatively rigid synthetic resin or plastic material, such as by injecting the same into suitable molds and so designing the components of the pistol that they not only render themselves capable of being manufactured in such manner but also are readily assembled into a finished operative pistol, in a manner to minimize the cost of production thereof, the adaptation of the same to being manufactured in the stated manner requiring substantial revision of design of the components as compared with the rifles and pistols comprising the subject matter of the aforementioned prior U.S. Patents, details of the pistol comprising the invention being set forth hereinafter.

SUMMARY OF THE INVENTION

It is among the primary objects of the present invention to provide a pair of molded housing members which are substantially mirror images of each other and having cavities therein to receive a combination molded cylindridal barrel of a predetermined diameter, one end of which is integrally formed with and connected to one end of a cylinder of larger diameter than the barrel, there being a transverse wall at the junction of the two cylindrical members having a hole therethrough of much smaller diameter than the barrel for purposes of permitting air to be compressed in the cylinder by means of a piston actuated by a compressed spring to compress air in said cylinder and discharge the same through said hole in compressed manner for action against a rear piston end of a preferably soft and harmless projectile having a suction cup on the outer end thereof to effect at least temporary attachment of the projectile to a surface when the same is shot from the pistol.

Another object of the invention is to form integrally with the piston, a piston rod which extends therefrom in opposite direction from the barrel and has a longitudinal slot of appreciable length in the outer end thereof for purposes of receiving a pin which extends transversely in a breech slide which is hollow and slidable along the upper rearward portion of an elongated frame portion of a housing from which the hollow handle depends adjacent said rearward end. Said longitudinal movement of said breech slide moves the piston rearwardly to compress a coiled compression spring which surrounds the piston rod, and a transverse shoulder member on said piston rod adjacent the piston is engageable by a sear on a pivotally supported triggger mounted in said housing adjacent the handle, such rearward movement of the piston by the breech slide being effected until said sear engages said transverse shoulder to maintain the piston in cocked position.

A further object of the invention is to form said breech slide in bipartite manner to form a shell, having opposite parallel sides and a top portion, the lower edges of the sides being straight and provided with grooves which slidably move upon complementary ribs formed on the outer surfaces of opposite portions of the sides of said housing, and said breech slide supporting a transverse pin in complementary transversely opposite sockets, said pin extending through the slot in said piston rod and being operable to engage the rear end of said slot to pull the piston rearwardly while compressing the spring and until the sear engages the transverse shoulder on said piston rod to maintain the pistol in cocked condition, as stated above, the several parts of the breech slide being secured together by appropriate screws.

Still another object of the invention is to include a small tension spring connected at one end to the interior of said breech slide and the opposite end being secured to fixed means on the interior of said housing, said spring being extended when said breech slide is moved rearwardly to cock said pistol and upon being cocked, said slide may be released from manual engagement and automatically will be restored to its forward normal position by means of said tension spring.

Another object of the invention is to provide the interior of the molded halves of said housing with appropriate positioning and strengthening ribs integral with the hollow interior of said halves of the housing, said ribs being provided with notches where necessary to support certain elements mounted on the interior of said housing.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 1 is a side elevation of a toy air pistol embodying the principles of the invention.

FIG. 2 is a vertical sectional view of operating parts of the air pistol which are contained on the interior of one molded half of the frame and housing shown in FIG. 1, certain of the components not being sectioned.

FIG. 5 is a fragmentary vertical sectional view showing details of the mechanism illustrated in FIG. 2, as seen on the line 5—5 thereof and looking forwardly.

FIG. 6 is another fragmentary vertical sectional view of the interior of the pistol shown in FIG. 2, as seen on the line 6—6 of FIG. 2 and looking rearwardly.

DETAILED DESCRIPTION OF THE PREFERRED EMBODIMENTS

Figure 3:
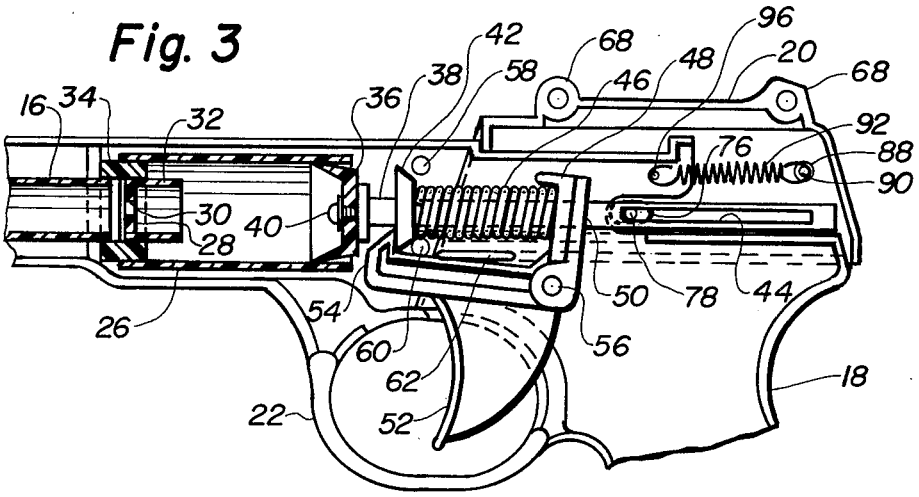
FIG. 3 is a fragmentary, partially vertically sectioned view of the mechanism shown in FIG. 2, and showing the piston in retracted, cocked position and the breech slide being in its forward normal position.

Referring to FIG. 1, it will be seen that the pistol 10 has been styled relatively closely to resemble an actual pistol formed from metal, such as a Colt 45 caliber pistol, but the toy pistol of the invention is almost entirely molded from relatively rigid plastic material, the housing 12 comprising a frame portion 14, which is elongated and encloses a barrel 16, which is open at the forward end at the left of FIG. 1, and a handle 18 depends from the rearward end of the frame portion 14. A breech slide 20 is slidably guided for longitudinal movement at the rear end of the frame portion 14, directly above the handle 18.

The housing 12 comprising the frame portion 14 and handle 18 is integral and preferably comprises two halves, each half comprising a hollow shell of relatively thin walls, but nevertheless, sufficiently thick in conjunction with the stiffness of the plastic material to provide adequate strength and stability capable of withstanding the action and operation of the moving parts described in detail hereinafter. One of said halves of the housing solely supports the molded trigger guard 22 but, otherwise, said halves of the housing are substantially similar mirror images of each other, with the exception of one of said halves also including a number of integrally molded plastic pins, which, where necessary for strength, have the outer end received in a socket molded in the other half of the housing, as described in detail hereinafter.

Referring to FIG. 2, the interior of the forward portion of each half of the housing 12 is provided with a pair of longitudinally spaced vanes or ribs 24, which have arcuate recesses therein for purposes of receiving the cylindrical molded barrel 16, as can be visualized from FIG. 2. The rearward end of the barrel 16 is integral and coaxial with a cylinder 26 of larger diameter than the barrel. At the junction of the barrel 16 and cylinder 26, a transverse wall 28 is formed and is provided with a central hole 30 of relatively small diameter and the barrel 16 also has a short extension 32, which projects into the cylinder 26, as shown in FIG. 2. Further, an annular boss 34 is formed at the junction of the barrel 16 and cylinder 26 and abuts the inner surface of the innermost rib 24 as shown in FIG. 2. At least portions of the outer surface of the cylinder 26 are at least partially closely engaged by the inner surfaces of the shell-like interior of the opposite halves of the housing 12, as can be visualized from FIG. 2.

Slidable within the cylinder 26 is a piston 36 which preferably is cup-shaped and the forward rim thereof preferably is relatively thin to provide close wiping action with the inner surfaces of the cylinder 26. The piston 36 is secured to the forward end of piston rod 38, which preferably is relatively square in cross-section. The connection is made by any convenient means, such as a screw 40, which is threaded into the forward end of the piston rod 38. Also, integrally molded with the piston rod 38 is a transverse shoulder member 42, which preferably is circular and frusto-conical, the widest diameter thereof being forward, toward the barrel 16, as shown in FIG. 2. The piston rod 38 also extends rearwardly a substantial distance and the rearward portion thereof is provided with an enlongated slot 44 and a coiled compression spring 46 of substantial strength surrounds the piston rod 38, the forward end of the spring abutting the rearward face of the shoulder member 42 and the opposite end thereof engages the forward face of a yoke 48 between the arms of which the piston rod 38 extends and to reinforce the parallel legs of the yoke, the outer surfaces thereof preferably are provided with integral reinforcing ribs 50.

The yoke 48 is integral with the arcuate-shaped trigger member 52, the forward end of which has a hook-shaped sear 54, the trigger also having a hole therethrough adjacent the rearward end thereof through which a pivot pin 56 extends, said pivot pin preferably comprising an integrally molded circular plastic projection formed on one half of the housing 12 and extending into a recess formed in the opposite half of the housing to provide adequate strength to support the trigger. The rearward face of the sear 54 engages the forward face of the circular shoulder member 42 when the pistol is in cocked position as shown in FIG. 3. Also, one of the half shells of the housing 12 is provided with a pair of integrally molded circular projections 58 and 60, which aid in stabilizing the position of the coiled compression spring 46 and also limit the upward movement of the sear 54 on the trigger 52, such limiting of the upward movement of the trigger and sear being further augmented by a short rib 62, as clearly shown in FIGS. 2 and 3.

The breech slide 20 also is bipartite and is shell-like and composed of two halves which are mirror images of each other, the same being shown in cross-section in FIG. 6. Each half has a sidewall 64 and the inner surfaces thereof closely and slidably engage the outer surfaces of upper sidewall portions of the frame portion 14 of housing 12. The two halves 64 have inwardly extending upper portions 66, as shown in FIG. 6, from which a pair of ears 68 extend upwardly to receive connecting screws 70 by which the two halves are securely connected. The lower portions of the inner surfaces of the sidewalls 64 of the breech slide 20 also are provided with straight, parallel elongated grooves 72, which slidably receive complementary elongated ribs 74, which extend along the outer surfaces of opposite sides of the frame portions 14 of housing 12, as best shown in FIG. 6.

The inner surfaces of the sidewalls 64 of breech slide 20 also are provided with cup-shaped projections 76 which respectively receive the opposite ends of a metal pin 78, which extends through the slot 44 in the piston rod 38, as clearly shown in FIG. 6.

Referring to FIG. 2, wherein the breech slide 20 is in its normal forward position, it will be seen that the spring 46 is in expanded condition, the piston 36 is forward within the cylinder 26 and the pin 78 is in the rear end of slot 44. For convenience, the breech slide 20 also is provided with a plurality of serrations or ribs 80 to facilitate manual engagement with the opposite sides of the breech slide in order that the same may be pulled rearward to the exemplary rearmost position shown in FIG. 4, said rearward movement of the breech slide 20 being limited by engagement of a portion of the forward wall 82 thereof, see FIG. 4, abutting an upstanding stop member 84, extending upward from the top wall portion 86 formed on each of the halves of the housing 12. When in the position shown in FIG. 4, the sear 54 automatically engages the forward wall of the shoulder member 42 to cock the pistol, said sear being maintained in said position due to the tightly coiled spring 38 abutting the forward surfaces of the legs of the yoke 48 and thereby urging the trigger 52 clockwise relative to the pivot pin 56.

Figure 4:
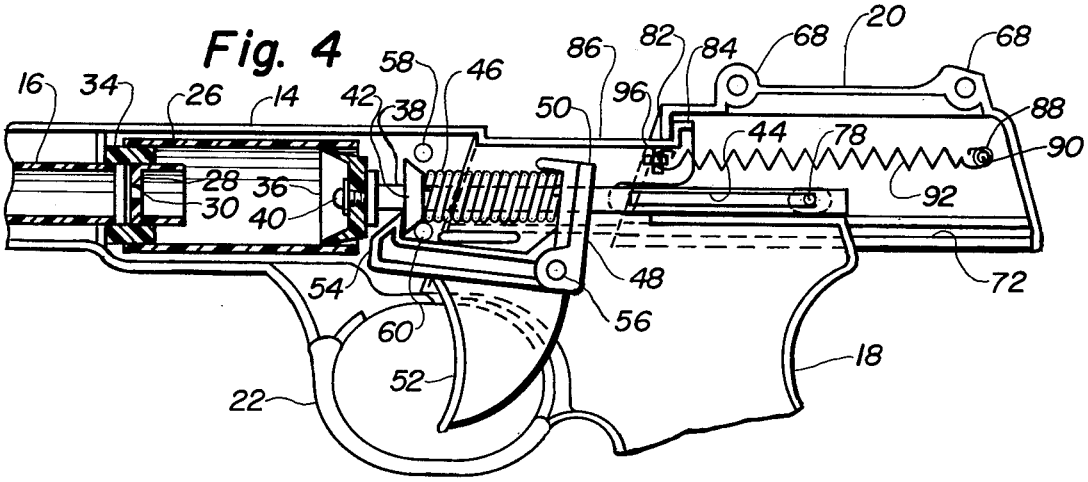
FIG. 4 is another fragmentary view similar to FIG. 3, but showing the breech slide moved to fully expanded position which it occupies after having effected a cocking operation of the piston.
Figure 8:
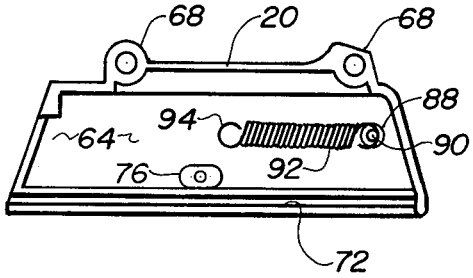
FIG. 8 is an interior side elevation of one half of the breech slide and showing therein the small tension spring by which the slide is restored to forward position, as seen in FIG. 2.

As shown in FIG. 8, the opposide halves of breech slide 20 are provided with cup-shaped projections 88, which are in transverse alignment with each other for purposes of receiving opposite ends of a pin 90 which extends through a loop at one end of a small coiled tension spring 92, the opposite end 94 being received upon an integral molded pin 96 which extends inward from one of the halves of the housing 12. When the breech slide 20 is in its normal forward portion, as seen in FIGS. 2 and 3, the spring 92 is contracted. However, when the breech slide 20 is manually and slidably moved rearwardly to its maximum extended position, as shown in FIG. 4, it will be seen from said figure that the spring 92 has been substantially extended between the pins 90 and 96 and, when the breech slide 20 is released, the spring 92 automatically restores the breech slide 20 to its forward normal position shown in FIGS. 2 and 3. During such movement, the metal pin 78 carried by the breech slide 20 moves forwardly within the slot 44 in the piston rod 38 and thereby restores the pin 78 substantially to the forward end of said slot 44, as seen in FIG. 3, while the pistol remains cocked, as shown in FIG. 3.

Figure 7:
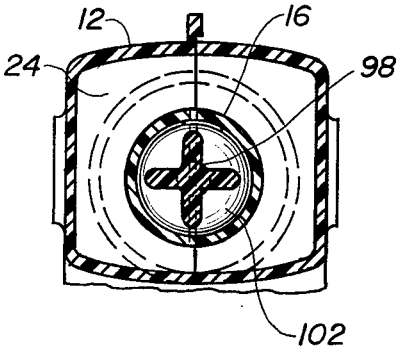
FIG. 7 is still another fragmentary vertical sectional view of the forward portion of the pistol shown in FIG. 2, as seen on line 7—7 thereof and looking rearwardly.

The cylindrical barrel 16 receives the shaft 98, see FIG. 2, of an elongated harmless projectile preferably molded from plastic material which is quite soft, the forward end thereof having a suction cup 100 formed thereon. As best shown in FIG. 7, for purposes of imparting relative rigidity to the soft material of the shaft 98, said shaft is cross-shaped in cross-section and composed of a plurality of ribs illustrated in cross-section in FIG. 7, and the rearward end of the shaft is provided with a relatively thin circular piston 102, shown in FIG. 2, and slidably and closely engaging the inner walls of the tubular barrel 16. To limit the insertion of the projectile into the barrel 16, the inner end portion thereof is provided with a transverse pin-like strut 104 of small diameter so as to not adversely impede the discharge of compressed air through the small hole 30 in wall 28 for action against the thin piston 102 of the projectile. Strut 104 also blocks the insertion of dangerous projectiles.

From the foregoing, it will be seen that the mechanism which is particularly shown in detail in FIGS. 2 and 3, as well as FIGS. 5 and 6, is very compact and readily capable of easily being assembled. For example, after assembly of most of the elements in one of the shell-like halves of the housing 12, the other shell-like half is connectable to the first half and the two halves are secured together, for example, by screws 106 which extend through circular bosses 108, respectively, formed in said halves of the housing 12 and thereby secure the handle portions of said halves together. The forward portions of the shell-like halves which contain the barrel 16, for example, preferably are secured by cement. The halves of the breech slide 20 are secured by screws 70 as indicated hereinabove, the halves of said breech slide 20 being assembled with the rear portion of the housing 12 by co-engaging the grooves and ribs 70 and 72 before applying the screws 70 to said shell-like halves of the breech slide 20.

Due to the provision of the slidable breech slide 20 by which rearward movement cocks the pistol, actuation of the toy pistol comprising the invention is rendered life-like and simulates the action of a conventional firearm-type pistol, such as a Colt 0.45 caliber pistol. Release of the sear 54 from the shoulder member 42 is accomplished by exerting relatively light force, following which the compressed spring 46 instantly urges the piston 36 forwardly to compress air within the cylinder 26 and discharge the same through the small hole 30 against the thin circular piston 102 of the projectile, the discharge of compressed air being adequate to propel the projectile substantial distances and the suction cup 100, at least momentarily, adheres the projectile to a surface hit thereby.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy air pistol for shooting relatively soft harmless elongated projectiles having a suction cup on one end and a thin piston on the other end, said pistol comprising in combination a rigid hollow molded housing having an elongated upper horizontal frame portion and a handle depending from the normally rearward end thereof, a trigger pivotally supported by said frame portion adjacent said handle, a cylindrical barrel of uniform diameter supported fixedly within said frame and extending inward from the normally forward end of said frame portion and axially extending from and communicating with a cylinder of uniform and larger diameter than said barrel affixed to the interior of said housing and extending rearwardly therein from said barrel, a piston slidably disposed within said cylinder and including a piston rod thereon extending rearwardly and axially from said barrel, a coiled compression spring surrounding said piston rod, a sear on one end of said trigger and a yoke on the other end extending perpendicularly to the axis of said cylinder, a transverse shoulder member on said piston rod adjacent and rearwardly of said piston and said piston rod extending through and rearwardly beyond said yoke on said trigger, the opposite end of said compression spring respectively abutting said shoulder member thereon and said yoke, and a simulated hollow breech slide having parallel opposite generally flat sides slidably supported by and external of the rearward portion of said upper horizontal frame portion above said handle for manual engagement and slidable movement along said horizontal frame portion, said opposite sides of said breech slide being provided with internal surfaces which slidably engage external surfaces of said rearward portion of said upper horizontal frame portion to provide the slidable support for said breech slide, and the rearward portion of said piston rod having a slot extending longitudinally from the rearward end thereof toward said piston, and a pin fixed transversely to and extending between said opposite sides of said breech slide rearwardly of said yoke and extending through said slot, whereby when said breech slide is moved rearward, said piston and piston rod are moved rearward and thereby compress said spring between said shoulder and yoke until said sear on said trigger latchingly engages said shoulder on said piston rod to cock the pistol for firing by pulling said trigger to disengage said sear from said shoulder and cause said piston to be instantly shot forward to compress air in said cylinder and discharge the same into said barrel against the piston on said projectile when positioned longitudinally in said barrel.

2. A toy pistol according to claim 1 in which said breech slide is substantially U-shaped in cross-section and closed at the rearward end and has opposite sides parallel to each other and the opposite sides of said elongated upper horizontal frame portion of said housing slidably interfitting elongated straight grooves and ribs formed on the slidably related surfaces on said sides of said breech slide and said frame portion to guide forward and rearward straight reciprocable movement of said breech slide, and a retraction tension spring mounted between said breech slide and frame portion and operable automatically to return said breech slide to the initial forward position thereof after said slide has been moved rearwardly to cock said pistol.

3. The toy pistol according to claim 1 in which said breech slide is bipartite and comprises similar opposite side members which are mirror images of each other, the inner surfaces of said opposite side members having complementary transversely coaxial sockets formed thereon and respectively receiving the opposite ends of said pin which extends through said slot in said piston rod, and transversely extending means securing said side members of said breech slide operatively together.

4. The toy pistol according to claim 1 in which a transverse wall extends between the inner end of said barrel and the adjacent end of said cylinder, said wall having an air discharge hole therethrough of substantially smaller diameter than said barrel, and a pin-like strut extending transversely across the inner end of said barrel forwardly of said wall to limit the insertion of projectiles into said barrel without interfering adversely with the discharge of air past the same.

5. The toy pistol according to claim 1 in combination with a projectile which is harmless and molded homogeneously from soft synthetic plastic material, said projectile having an elongated shaft composed of ribs in a substantially cross-shape orientation to generally sustain straightness thereof, a suction cup on one end of said shaft, and a relatively thin transverse circular piston member on the other end of said shaft of a diameter substantially equal to the inner diameter of said barrel.

* * * * *